US006371756B1

(12) United States Patent
Toohey

(10) Patent No.: US 6,371,756 B1
(45) Date of Patent: Apr. 16, 2002

(54) SELF-FEEDING WAX CANDLE

(75) Inventor: Todd Toohey, P.O. Box 1129, Point Pleasant Beach, NJ (US) 08742

(73) Assignee: Todd Toohey, Point Pleasant Beach, NJ (US)

( * ) Notice: Subject to any disclaimer, the term of this patent is extended or adjusted under 35 U.S.C. 154(b) by 0 days.

(21) Appl. No.: 09/771,185

(22) Filed: Jan. 29, 2001

(51) Int. Cl.[7] ..... F23D 3/16

(52) U.S. Cl. ..... 431/291; 431/289; 431/292; 431/290; 431/37; 431/64; 362/161

(58) Field of Search ..... 431/291, 288, 431/290, 292, 294, 11, 36, 37, 64, 119, 125, 126, 206, 207, 209, 215, 243, 330, 298, 333, 334, 242; 126/343.5 R, 343.5 A; 362/161; 425/803

(56) References Cited

U.S. PATENT DOCUMENTS

| | | | | | |
|---|---|---|---|---|---|
| 2,681,555 | A | * | 6/1954 | Babbitt | 431/294 |
| 5,078,945 | A | * | 1/1992 | Byron | 431/292 |
| 5,718,572 | A | * | 2/1998 | Hitzel | 431/292 |
| 5,980,241 | A | * | 11/1999 | Schirneker | 431/291 |
| 6,098,953 | A | * | 8/2000 | Machado | 431/294 |
| 6,220,855 | B1 | * | 4/2001 | Asheim | 431/294 |

FOREIGN PATENT DOCUMENTS

| | | | |
|---|---|---|---|
| DE | 36 40 757 A1 | * | 6/1988 |
| GB | 2 339 613 A | * | 2/2000 |
| JP | 9-69312 A | * | 9/1997 |

* cited by examiner

*Primary Examiner*—Henry Bennett
*Assistant Examiner*—Josiah C. Cocks

(57) ABSTRACT

A wax candle (10) positioned below a wax reservoir (30), which is held in position above candle (10) by a wax reservoir support (20). While burning, the heat emitted from the flame of candle (10) causes the wax contained in reservoir (30) to slowly and continuous melt. This melted wax drips down from reservoir (30) into candle (10) and replenishes the wax used for combustion on the wick of candle (10). The rate of this replenishment and the flame size of candle (10) are self regulating, and in direct relationship with each other during cycle outlined below:

An increase in flame size causes a subsequent increase in replenishment.

An increase in replenishment causes a subsequent decrease in flame size.

A decrease in flame size causes a subsequent decrease in replenishment.

A decrease in replenishment causes a subsequent increase in flame size.

And the cycle begins again.

This regulation of dispensed wax allows the surface level of candle (10) to remain relatively constant and does not "burn down" as a traditional candle's would. Therefore, by replacing the wax in reservoir (30) as needed, this candle can be used indefinitely.

1 Claim, 3 Drawing Sheets

SELF-FEEDING WAX CANDLE

BACKGROUND

1. Field of Invention

This invention relates to candles, specifically to a re-usable candle.

2. Prior Art

No prior art was discovered.

Objects and Advantages

Accordingly, several objects and advantages of my invention are:

(a) to provide a wax candle with a fiberglass wick which can be used perpetually.

(b) to provide a visually relaxing scene with liquid wax rhythmically dripping onto a clear glass sphere;

(c) to provide a means to recycle unused wax which may be left over after a traditional wax candle burns down;

(d) to provide a safe and non-flammable enclosure for a candle flame;

(e) to provide a safe and non-flammable container for a candle;

(f) to provide a safe and self extinguishing wick that will terminate combustion if too much or too little molten wax is in contact with it's surface;

(g) to provide the user with the ability to vary the type, color, and scent of the wax used by the candle.

DRAWING FIGURES

REFERENCE NUMERALS IN DRAWINGS

Wax Candle

12 Seamless metal candle container

13 Candle wax

14 Wick and drip diffuser keeper

- 14T Drip diffuser cradle
- 14W Wick arm

16 Fiberglass wick

- 16T Wick tip
- 16C Wick cylinder

18 Drip Diffuser

Wax Reservoir Support

22FL Front left panel

22FR Front right panel

24L Rear left panel

24R Rear Right panel

26 Panel connectors

Wax Reservoir

32 Wax reservoir container

- 32E Reservoir wax exit
- 32L Wax reservoir container lid
- 32R Drip release point

34 Reservoir wax

SUMMARY

In accordance with the present invention a self-feeding wax candle comprises a candle positioned beneath a wax reservoir containing a supply of solid wax. In use, small portions of wax contained in the reservoir above continuously melt and drip down, replenishing the wax used for combustion by the candle below.

Description—FIGS. 1 to 5

Figure 1:
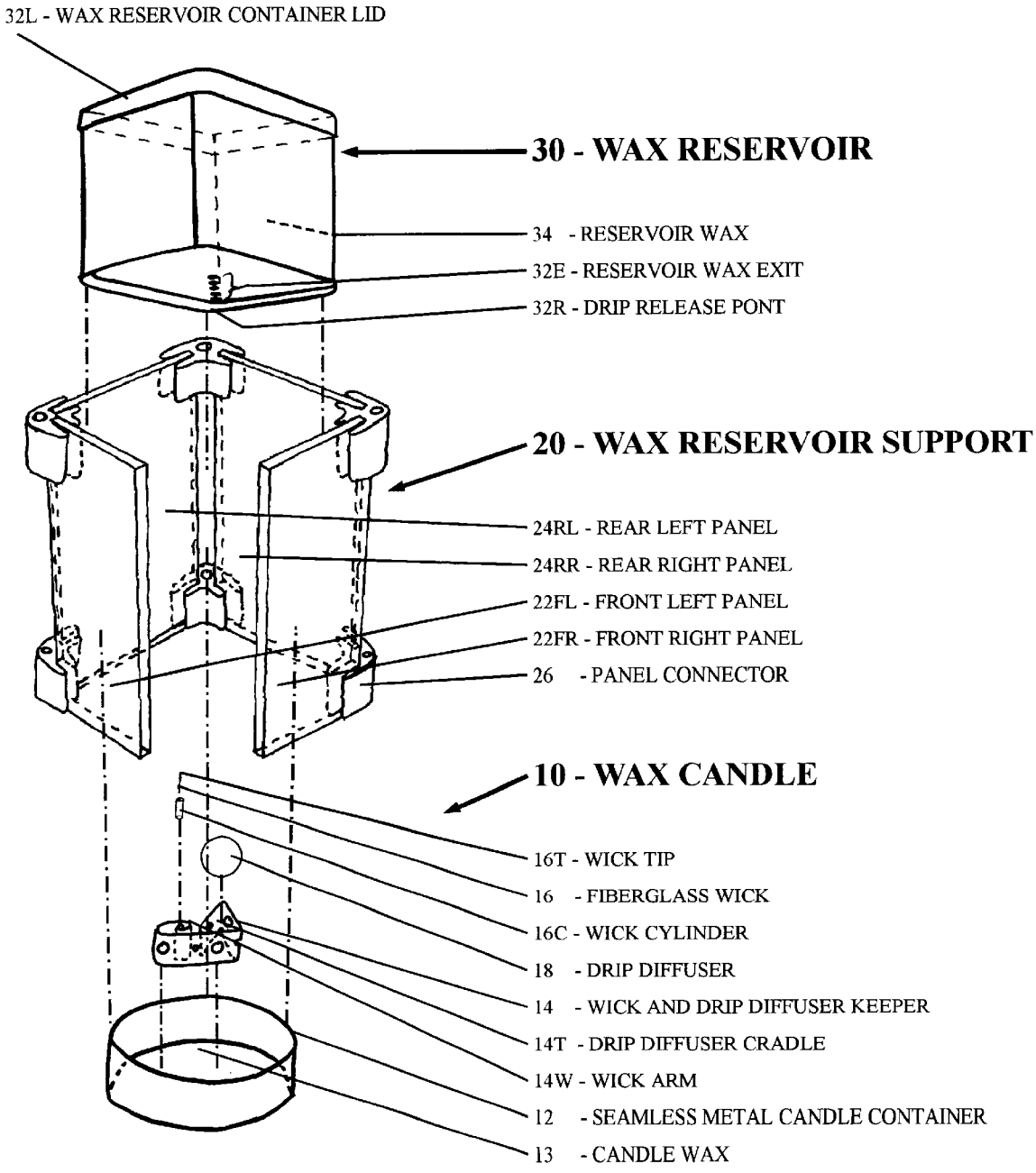
FIG. 1 shows an exploded view revealing all parts of a candle.

FIG. 1 shows an exploded view of a typical embodiment of my invention.

My candle has a base candle 10 consisting of:

A seamless metal candle container 12 which would be placed on an appropriate surface, in a suitable location for a candle. In the preferred embodiment, seamless candle container 12 is a separate unit composed of tin, available from Atlantic Sales & Distribution, INC. of Burlington, N.J. Candle container 12 is thirty-three millimeters high and eighty-nine millimeters in diameter. However, a candle container can consist of any other suitable material such as glass, plastic, ceramic, etc. Additionally, a candle container can be manufactured as an integral, adjustable or replaceable component, contained within a single unit, which would include a wax candle, a wax reservoir support and a wax reservoir therein.

Candle wax 13, installed while in a molten state into a candle container 12. The surface of installed candle wax 13 horizontally dissects the axis of a vertically positioned fiberglass wick 16 at a distance of eight millimeters below a wick tip 16T. Candle wax so installed, would then provide initial fuel for combustion on wick 16 of wax candle 10. In the preferred embodiment, this candle wax is typical paraffin wax. However, any suitable candle wax could be substituted such as; scented wax, dyed wax, granulated wax, gel wax, waxes with various melting points, etc.

A wick and drip diffuser keeper 14, that is positioned within candle wax 13, and contacts the inside bottom of candle container 12. Keeper 14 is situated in such a way as to position wick 16 in the center of candle wax 13 with the axis of wick 16 in a vertical orientation. In the preferred embodiment, this keeper 14 is a separate component comprised of a ten centimeter long and twenty-four millimeter wide piece of metal strap, commonly referred to as "pipe strap". This strap is bent as follows which allows it to remain stable while resting on its edge; one half of the metal strap's length is bent into a triangle configuration, thus forming a drip diffuser cradle 14T, the remaining two inches of strap is bent into a spiral form, thus forming a wick arm 14W. Wick arm 14W provides a cavity for a wick cylinder 16C to be installed into, so as to maintain the lumen of wick cylinder 16C in a vertical orientation. Wick 16 is installed into the lumen of wick cylinder 16C and held in position by a small amount of glue (not shown). Wick 16 and wick cylinder 16C comprise a single replaceable unit. Wick arm 14W is bent as needed to position the encircled wick cylinder 16C and enclosed wick 16 in a proper relation to a drip diffuser 18. In the proper relation, wick tip 16T is eight millimeters away from, and level with the nearest point on the equator of diffuser 18. However, a keeper can consist of any suitable material, formed in such a manner as to position the fiberglass wick and drip diffuser in an appropriate position. Additionally, a keeper can be manufactured as an integral or adjustable component, contained within a single unit, which would include a wax candle, a wax reservoir support and a wax reservoir therein.

Wick 16, is composed of fine fiberglass strands and is installed in a wick cylinder 16C. Wick cylinder 16C is a tiny glass cylinder that is 26 millimeters long, seven millimeters in diameter, with a lumen that is three millimeters wide. In the preferred embodiment, wick 16 is fifteen millimeters long and three millimeters in diameter. However, the wick can be constructed instead from any suitable non-combustible material, with a variety of dimensions, and capable of performing the traditional functions of a candlewick. Additionally, a candlewick can be manufactured as an integral or adjustable component, contained within a single unit, which would include a wax candle, a wax reservoir support and a wax reservoir therein.

A drip diffuser 18 positioned to receive drops of molten wax as they fall from a wax reservoir 30. In the preferred embodiment, diffuser 18 is a glass sphere being twenty-five millimeters in diameter. Diffuser 18 rests on drip diffuser cradle 14T, and is held in position by gravity. However, the drip diffuser can be constructed from any other suitable material such as stone, ceramic, steel, etc. And can be shaped in any other suitable configuration such as oval, teardrop, barrel convoluted, etc. Additionally, a drip diffuser can be manufactured as an integral or adjustable component, contained within a single unit, which would include a wax candle, a wax reservoir support and a wax reservoir therein. Additionally, a drip diffuser can be configured in such a manner as to produce a pleasant sound as molten wax drips onto it's surface.

My Candle has a Wax Reservoir Support 20 Consisting of:

Four plate glass panels having a thickness of six millimeters and a length of nineteen centimeters. Front panels 22FL and 22FR are six centimeters wide, while rear panels 22RL and 22RR are seventeen centimeters wide. In the preferred embodiment, the panels are attached with panel connectors 26 in the following sequence; a front left panel 22FL attaches on its rear side to the front side of a rear left panel 22RL, which attaches on its back side to the back side of a rear right panel 22RR, which attaches on its front side to the back side of a front right panel 22FR. This connection sequence forms a hollow, four-sided glass column. The front left panel and the front right panel do not connect to each other, creating a five centimeter gap that extends from the bottom to the top of support 20. This gap allows access to wick 16 for lighting and extinguishing. Perched on top of support 20, and held in place by gravity, is a wax reservoir 30. However, a wax reservoir support can be constructed from any other suitable material such as plastic, stone, mirrors, ceramic, steel, etc. And can be shaped in any other suitable configuration such as oval, circular, perforated etc. Additionally, a wax reservoir support can be manufactured as an integral or adjustable component, contained within a single unit, which would include a wax candle, a wax reservoir support and a wax reservoir therein. Also, a wax reservoir support can be constructed with a configuration that baffles air circulation around the candle, thus allowing the candle to function in a breezy environment. Mirrored surfaces can be incorporated into the reservoir support as well.

My Candle has a Wax Reservoir 30 Consisting of:

A wax reservoir container 32 that contains a reservoir wax 34. In the preferred embodiment, wax reservoir container 32 is a separate unit composed of tin, available from Atlantic Sales & Distribution, INC. of Burlington, N.J. Reservoir container 32 is nine centimeters wide, by nine centimeters long, by ten centimeters high. A reservoir wax exit 32E is provided on the bottom of reservoir container 32 which allows molten wax to egress and drip down from a drip release point 32R during operation to candle 10 below. Wax exit 32E is formed by a linear series of perforations in the bottom of reservoir container 32. These perforations are located bet ween the center on the bottom of reservoir container 32 and a drip release point 32R. Drip release point 32R is located on the lowest corner of the bottom of reservoir container 32 as it sits installed on top of support 20. Within reservoir container 32 is space provided for storage of reservoir wax 34 that is gradually consumed during the operation of my candle. This storage space can be accessed by operating a wax reservoir container lid 32L thus allowing the user to replenish the enclosed supply of reservoir wax 34. However, a wax reservoir container can consist of any suitable material such as glass, ceramic, stone, etc. Additionally, a wax reservoir container can be manufactured as an integral or adjustable component, contained within a single unit, which would include a wax candle, a wax reservoir support and a wax reservoir therein.

From the description above, a number of advantages of my candle become evident:

(a) A single candle can be used to burn an infinite number of wax types with different types, colors and scents.

(b) When using my candle there is never any unused wax to be discarded.

(c) Containment is provided for all molten wax keeping it from escaping into the surrounding environment.

(d) Safety features include flame shielding, automatic flame-size control, and a self-extinguishing wick.

(e) My candle will burn longer than any other wax candle.

Figure 2:
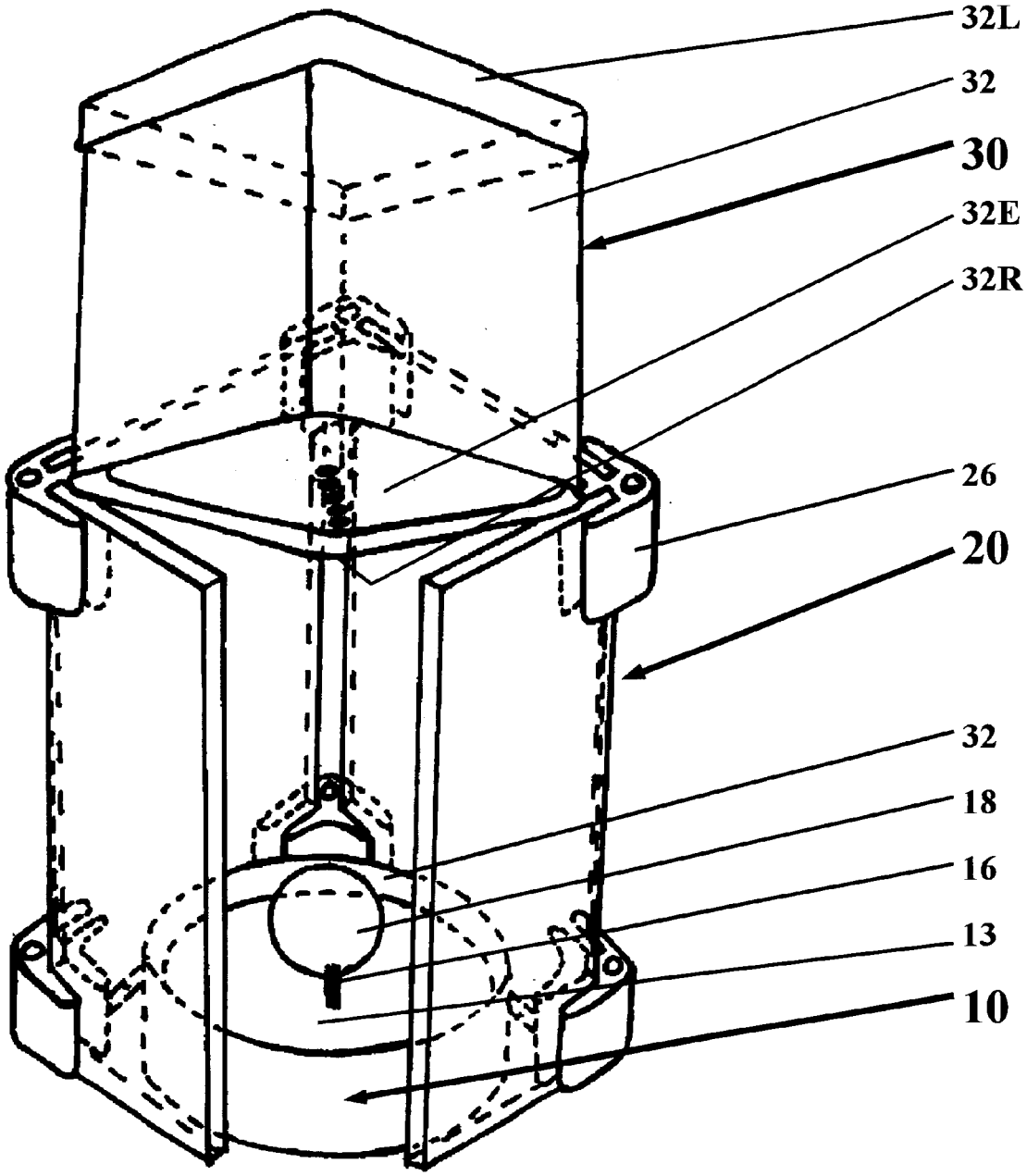
FIG. 2 shows a perspective view of a candle set up for use.
Figures 3A, 3B:
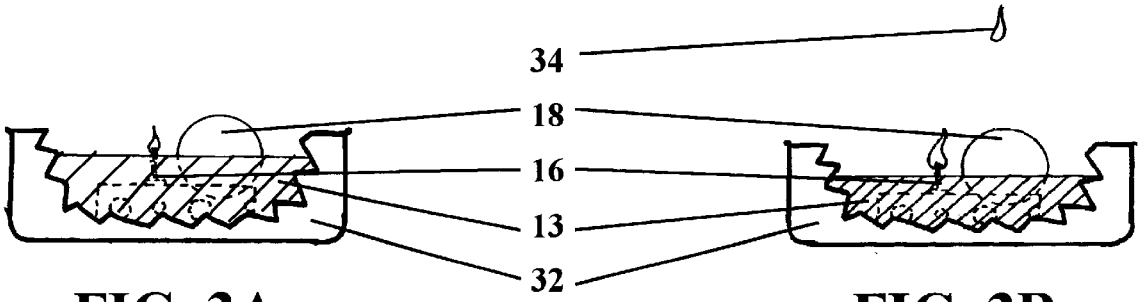
FIG. 3A shows a cutout side view of a candle, illustrating a high level of molten candle wax.
FIG. 3B shows a cutout side view of a candle, illustrating a balanced level of molten candle wax.
Figures 3C, 3D:
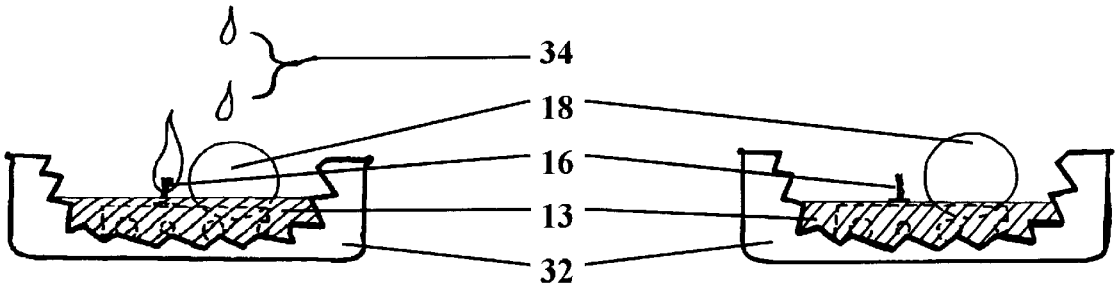
FIG. 3C shows a cut-out side view of a candle, illustrating a low level of molten candle wax.
FIG. 3D shows a cut-out side view of a candle, illustrating a wax starvation level of molten candle wax.
Figure 4:
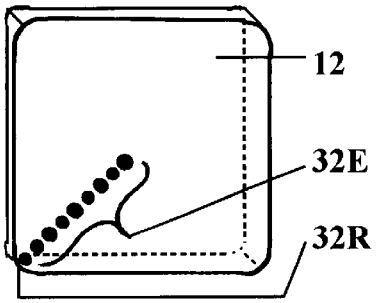
FIG. 4 shows a perspective bottom view of a wax reservoir exit.
Figure 5:
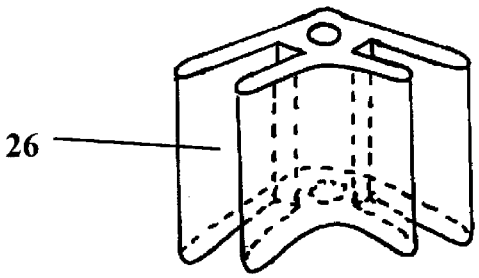
FIG. 5 shows a perspective large-scale view of a panel connector.

Operation—FIGS. 2, 3, 4

The manner of operating the eternal candle can be divided into three categories; setup, enjoyment and maintenance. After initial setup of the preferred embodiment, the candle does not need to be setup again between uses unless maintenance is needed. However, an embodiment comprised of a single unit containing a wax candle, a wax reservoir support and a wax reservoir, would eliminate the need for setup at any time.

Setup of the preferred embodiment involves lighting wick 16 and subsequently positioning the three main components, candle 10, support 20 and reservoir 30 in proper relation to each other (FIG. 2). Wick 16 can be lit in the same manner as a traditional wax candle with a match, butane lighter, burning candle, etc. The burning candle 10 is positioned in an appropriate location with diffuser 18 positioned behind wick 16 (FIG. 2). Reservoir support 20 is then positioned over candle 10 with the vertical opening of support 20 facing forward (FIG. 2). Reservoir 30 is then perched on the cornice of support 20 (FIG. 2). When so perched, reservoir 30 must have reservoir wax exit 32E facing forward (FIG. 2). Drip release point 32R must be the lowest point on reservoir 30 (FIG. 2). Also, drip release point 32R must be positioned directly above diffuser 18 (FIG. 2). In this configuration the eternal candle will enter a perpetual burning cycle, during which it can be enjoyed as any other traditional candle.

Enjoyment of the eternal candle includes but is not limited to; soft candle light, observing rhythmic dripping of molten wax onto a clear glass marble, the aroma of any scent added to reservoir wax, etc. While the user is enjoying the eternal candle, the candle is maintaining a steady flame as a result of the candles subtle burning cycle. The burning cycle will self sufficiently continue until the flame is exposed to a heavy breeze, the flame is extinguished, or the wax supply in reservoir 30 is depleted. During the burning cycle, candle 10 will be in on e of three phases (FIGS. 3A, 3B and 3C). The low phase (FIG. 3C) is entered into as a result of slightly more wax being burned on wick 16 than is being replenished by reservoir 30. This condition causes more of the surface area of wick 16 to be exposed above the molten surface of candle wax 13. With a greater surface area exposed on wick 16, the flame size of candle 10 increases. As the flame size of candle 10 increases, its heat output increases and the temperature of reservoir 30 above increases as well. As the temperature of reservoir 30 increases, the melting rate of reservoir wax 34 increases inside of reservoir 30. This increase in the melting rate of reservoir wax 34 causes more molten reservoir wax 34 to flow out through reservoir wax exit 32E (FIGS. 1, 2, 4), and drip from drip release point 32R (FIGS. 1, 2, 4). As more wax drips down into candle 10, the level of molten candle wax 13 in candle 10 rises. A rising level of molten candle wax 13 in candle 10 causes the candle to enter the high phase (FIG. 3A). A higher level of molten candle wax 13 causes less surface area on wick 16 to be exposed above the surface of molten candle wax 13. Consequently, with less surface area exposed on wick 16 above the molten surface of candle wax 13, the flame size of candle 10 decreases. As the flame size of candle 10 decreases, its heat output decreases, and the temperature of reservoir 30 above decreases as well. As the temperature of reservoir 30 decreases, the melting rate of reservoir wax 34 decreases inside of wax reservoir 30. This decrease in the melting rate of reservoir wax 34 causes less molten reservoir wax 34 to flow out through reservoir wax exit 32E (FIGS. 1, 2, 4), and drip from drip release point 32R (FIGS. 1, 2, 4). As less wax drips down into candle 10, the level of molten candle wax 13 in candle 10 falls slightly. A falling level of molten candle wax 13 in candle 10 causes the candle to enter the low phase (FIG. 3C). As the eternal candle fluctuates slowly between the high phase (FIG. 3A) and the low phase (FIG. 3C), it enters a balanced phase (FIG. 3B) for a period of time. The length of time that the candle stays in a balanced phase depends on how stabilized the influencing factors are. These influencing factors include but are not limited to; air temperature around the candle, air movement around the candle, distance between drip release point 32R and drip diffuser 18, melting point of wax being used, amount of wax in wax reservoir 30, etc.

Maintenance of the eternal candle is required when; reservoir wax 34 needs replenished (approximately every 50 hours of use), reservoir wax 34 is allowed to run out during use, wick 16 develops carbon deposits on wick tip 16T, diffuser 18 becomes scorched. Reservoir wax 34 is replenished by simply lifting reservoir 30 off of support 20, removing a wax reservoir container lid 32L from reservoir container 32, placing candle wax (solid) inside reservoir container 32, replacing wax reservoir container lid 32L on reservoir container 32, and replacing reservoir 30 on reservoir support 20. If reservoir wax is allowed to run out during use, then the following steps must be taken to prepare candle for future use; reservoir wax must be replenished as outlined above, soot deposits left as a result of continuous high flame can be cleaned up with vinegar, level of candle wax 13 must be raised above the top of the wick cylinder 16C by manually placing wax into candle 10 (small pieces of solid wax can be used), and wick 16 must have a few drops of molten wax (from another candle) dripped onto it. If wick 16 develops large carbon deposits on wick tip 16T, then wick 16 can be replaced as follows; candle 10 can be positioned on an electric heating surface (such as a coffee maker) and allowed to warm up until all candle wax 13 within candle container 12 is in the molten state, then wick 16 can be removed (with wick cylinder 16C attached) from wick arm 14W by grasping the wick 16 and lifting straight up while candle wax 13 is still molten. A replacement wick (wick 16 and attached wick cylinder 16C) can be lowered into the wick arm 14W and the wax candle should then be allowed to cool (until all candle wax 13 solidifies) before moving. If diffuser 18 becomes scorched simply allow candle to cool, pry drip diffuser 18 out of candle wax 13, and clean scorch marks with vinegar.

Summary, Ramifications, and Scope

Accordingly, the reader will see that the Eternal Candle can be used and enjoyed as any traditional candle can be. Beyond all the usual benefits of a traditional candle, the Eternal Candle offers safety features such as:

- A short wick length that will keep the flame size small and safe at all times.
- A wick designed that will extinguish it's own flame if the reservoir discharges too much wax or is allowed to run dry during operation.
- A glass column that surrounds the candle and forms a physical barrier against flammable material that might otherwise accidentally come in contact with the candle's flame
- Non-flammable containment for all wax (In either a solid or molten state) that will prevent wax from entering the surrounding environment.

Additionally, the Eternal Candle provides the user with the opportunity to control (and alter if desired) the type of wax being dispensed by the reservoir and subsequently burned by the candle. Such control enables a user to exercise such options as

- Recycling the burned out shell of a traditional candle by placing it in the reservoir and allowing it to melt into, and be used by, the candle below.
- Using scented wax in the reservoir for enjoying an unlimited variety of aromas.
- Using colored wax in the reservoir for enjoying an unlimited variety of colors.
- Create and enjoy personal blends of wax aroma and wax color without having to actually construct a complete and functional candle.

Although the description above contains multiple specificities, these should not be construed as limiting the scope of the invention but as merely providing illustrations of some of the presently preferred embodiments of this invention. For example, the candle can be constructed from one piece of material rather than three separate parts. Also, the column surrounding the candle can be constructed so as to protect the rising column of heated air above the flame from drafts with complete enclosure and baffled ventilation.

Thus the scope of the invention should be determined by the appended claims and their legal equivalents rather than by the examples given.

I claim:

1. A wax candle which continuously replaces the wax it burns, comprising:

a. a wax candle using a wick made from a noncombustible material, b. a wax reservoir, being a noncombustible container, encasing a supply of solid reservoir wax c. a wax reservoir support, which supports said wax reservoir above said wax candle, whereby, the level of molten candle wax and volume of molten candle wax surrounding the base of the burning wick of said wax candle will remain within a constant range as a result of the following cycle, a slight reduction in said level of molten candle wax results from consumption of said molten candle wax by combustion on said burning wick, which will cause more surface area of said burning wick to be exposed above said level of molten candle wax, which will cause an increase in flame size on said burning wick, which will cause an increase in the heat output by said burning wick, which will increase the temperature of said wax reservoir being held above said burning wick by said wax reservoir supports, which will cause a small amount of said reservoir wax inside said wax reservoir to become molten, which will cause said molten reservoir wax will egress form said wax reservoir through a plurality of holes in the underside of said wax reservoir, which will cause said egresing molten reservoir wax to drip into said wax candle located below said wax reservoir, which will cause said molten reservoir wax to mix with said volume of molten candle wax, which will cause the said level of molten candle wax to increase, which will cause less surface area of said burning wick to be exposed above said level of molten candle wax, which will cause a decrease in said flame size on said burning wick, which will cause a decrease in heat output by said burning wick, which will decrease the temperature of said wax reservoir being held above said burning wick by said wax reservoir support, which will cause said molten reservoir wax to solidify and stop falling into said wax candle, which will cause the level of said molten candle wax to stop increasing, which will cause cycle to begins again as a slight reduction in said level of molten candle wax results from consumption of said molten candle wax by combustion on said burning wick, whereby a wax candle can be burned indefinitely.

* * * * *